US005560703A

United States Patent [19]

Capps, III

[11] Patent Number: 5,560,703

[45] Date of Patent: Oct. 1, 1996

[54] HANDGUN LIGHT MOUNT

[76] Inventor: Lewis W. Capps, III, 106 Ridgewood Rd. West (P.O. Box 1765), Jasper, Ala. 35501

[21] Appl. No.: 407,605

[22] Filed: Mar. 21, 1995

Related U.S. Application Data

[63] Continuation-in-part of Ser. No. 143,934, Oct. 27, 1993, abandoned.

[51] Int. Cl.[6] ..... F41G 1/34

[52] U.S. Cl. ..... 362/110; 362/114; 42/103

[58] Field of Search ..... 362/110, 114; 42/103

[56] References Cited

U.S. PATENT DOCUMENTS

| | | | |
|---|---|---|---|
| 2,093,514 | 9/1937 | Cornett et al. | 362/114 |
| 2,450,584 | 10/1948 | Dodge | 362/114 |
| 4,348,716 | 9/1982 | Storm et al. | 362/110 |
| 4,542,447 | 9/1985 | Quakenbush | 362/114 |

*Primary Examiner*—Denise L. Gromada
*Assistant Examiner*—Alfred Basichas
*Attorney, Agent, or Firm*—C. A. Phillips; Joseph H. Beumer

[57] ABSTRACT

A mounting device for mounting a flashlight on a handgun has a first bracket for attachment to the grip of the handgun, the bracket being contoured to the surface of the handgun grip and engageable with the grip by friction. The bracket which engages the grip, extends partially around the grip, and is further urged against the grip by means of an elastic band. The first bracket is connected to a second bracket which holds a flashlight in desired alignment for coinciding with the barrel of the gun. The second bracket is located away from the grasping surface except for an upper region that is welded flush to the first bracket so as to not interfere with normal gripping of the gun. This attachment system avoids problems associated with fitting of prior attachments into holsters for handguns and provides a simple, readily attached and removed lighting device.

20 Claims, 3 Drawing Sheets

HANDGUN LIGHT MOUNT

CROSS REFERENCE OF RELATED APPLICATION

This application is a continuation-in-part of my prior application Ser. No. 08/143,934, filed on Oct. 27, 1993, now abandoned.

FIELD OF THE INVENTION

This invention relates to flashlight attachments for handguns.

BACKGROUND OF THE INVENTION

For over 90 years, proposals have been made for mounting lights to firearms. As far back as 1901, the U.S. Patent and Trademark Office issued U.S. Pat. No. 689,576, which proposed mounting an incandescent lamp on a firearm. Since 1901, the Patent Office has issued quite a few patents for devices to mount flashlights to firearms. In certain instances, it is imperative to have a light source attached to a handgun.

As addressed in U.S. Pat. Nos. 4,758,933 and 5,167,446, officers are required to carry a flashlight and a sidearm. Most police shooting situations are in dim light or low light conditions, and the officer typically holds his flashlight with one hand and his sidearm with the other. Holding a light in one hand and a handgun in the other hand puts the officer at a distinct disadvantage. U.S. Pat. No. 4,758,933 provides a notch on the grip of the handgun for indexing the flashlight. This arrangement gets the flashlight pointed in the right direction, but the officer still has to hold the light in one hand and the handgun in the other. Another example is shown in U.S. Pat. No. 5,167,446, in which a bracket is attached for the flashlight and is positioned on the handgrip and held in place by both hands as the weapon is grasped. This arrangement takes time to position, and the flashlight has to be removed before the weapon can be holstered. In U.S. Pat. No. 4,348,716, the flashlight is attached to the weapon by a bracket that is attached by adhesive tape to the grip of a handgun and can neither be holstered in a standard holster nor removed from the weapon quickly.

In U.S. Pat. No. 4,777,754, a high-powered light is semi-permanently mounted below the barrel of a handgun. This arrangement works well except the weapon cannot be holstered in a standard holster, and the light mount cannot be removed from the weapon very quickly.

In U.S. Pat. No. 4,542,447, the flashlight mounts onto the handgun barrel and removes very quickly, but the handgun cannot be holstered in a standard holster with the light mounted and will tend to come loose or fall off if the weapon is fired.

Another disadvantage of light mounts shown in the prior patents is that many of them require modification of the existing weapon as by drilling holes for use of screws or attachment of plates or otherwise tampering with the handgun.

SUMMARY OF THE INVENTION

The present invention is directed to a mounting system for removably attaching a light source to a handgun. The light mount comprises a first bracket partially encircling and having a surface conforming to the shape of the handgun grip and engageable therewith by friction. A second bracket is connected to the first bracket and carries a light such as a flashlight in alignment with the barrel of the handgun. The first bracket extends far enough around the grip to exert force on the grip from opposite sides. Except for a flat upper portion, the second bracket is located away from the grasping region of the handgun in a position such as not to interfere with grasping of the grip by the user.

An elastic band is preferably placed encircling the first bracket to urge it more securely against the grip and to keep it from shifting around upon firing of the weapon. A switch to turn the light on and off may be provided in the form of a pressure switch placed between the first bracket and the elastic band. The light may then be turned on by squeezing the band more firmly with fingers already in position encircling the grip.

Light mounts embodying the invention provide solutions to the drawbacks and problems associated with prior devices as discussed above. The mount and flashlight carried thereby may be attached quickly and surely without requiring screws or other modifications to the handgun. The handgun, with mount and light attached, conveniently fits a standard holster. Furthermore, the mount is light in weight and directs a beam of light to illuminate the object at which the weapon is pointed so that the user can line up his sights to fire at night.

DESCRIPTION OF THE PREFERRED EMBODIMENT

The invention is described herein with reference to two embodiments, one adapted for use on a semi-automatic handgun and the other adapted for use on a revolver.

Figure 1:
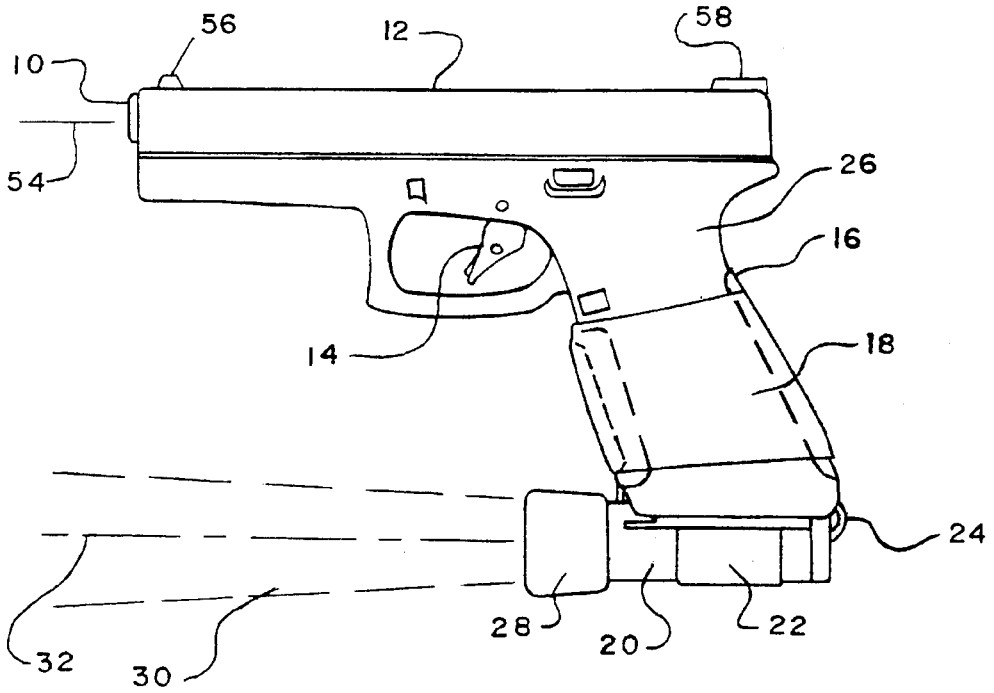
FIG. 1 is a side view of the present invention attached to a semi-automatic handgun, showing the light mount positioned correctly on a handgrip, with the light pointed toward a target.
Figure 2:
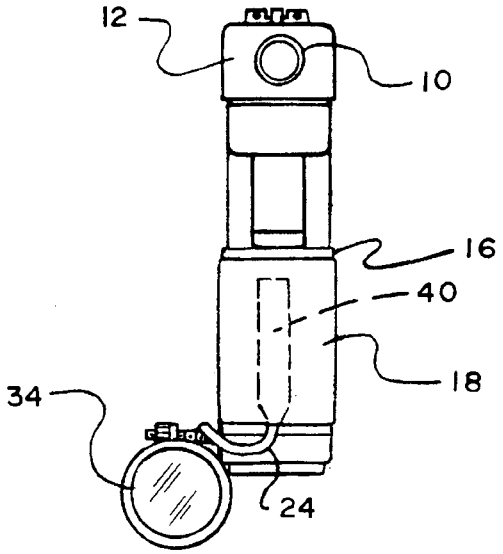
FIG. 2 is a front view of the embodiment of FIG. 1 of the invention.
Figure 3:
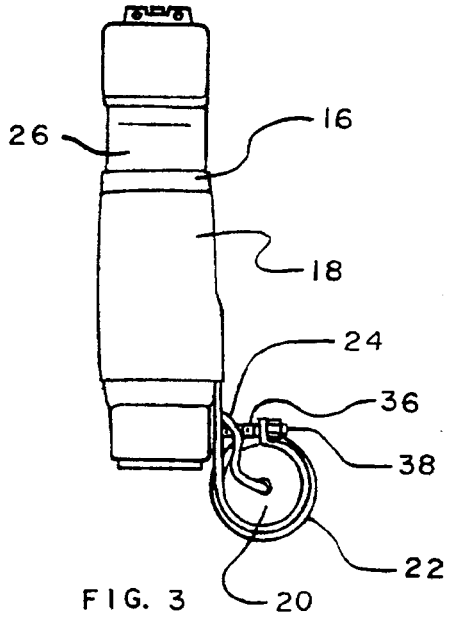
FIG. 3 shows a rear view of the same embodiment.
Figure 4:
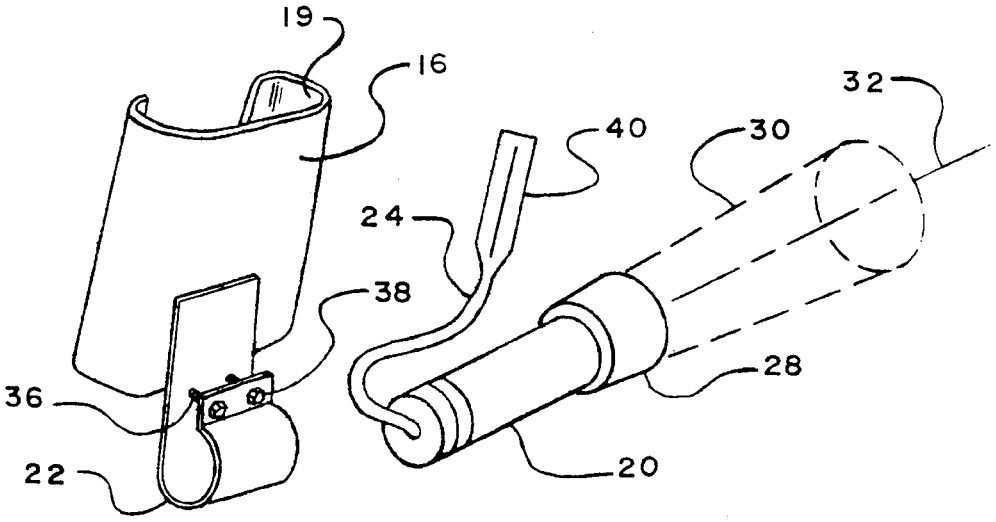
FIG. 4 is a perspective view of the light mount, with the elastic band and flashlight removed. Also shown is the flashlight with a pressure switch attached.
Figure 6:
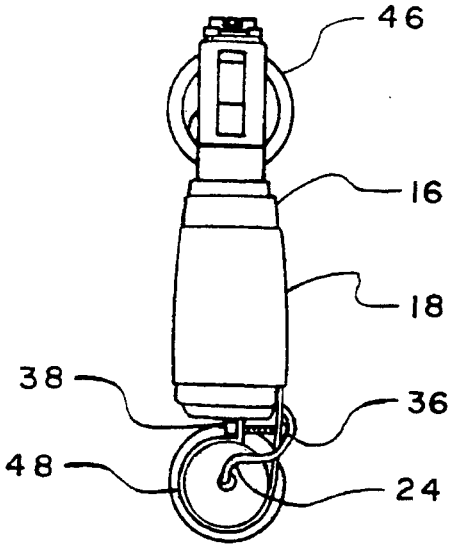
FIG. 6 shows a rear view of the embodiment of FIG. 5.

FIG. 1 shows a light mount apparatus 16 according to one of the preferred embodiments of this invention mounted on a firearm in the form of a Glock semi-automatic handgun. The handgun has conventional parts and components, including a barrel 10, a handgrip 26, a trigger 14, and a slide 12. As illustrated in FIG. 4, the flashlight mounting bracket 16 is shaped in the form of a C-shaped metal sheet configuration that wraps around over half of the circumference of the handgrip 26 and is connected to a second bracket 22 that is shaped to accept flashlight 20. In FIGS. 2 and 3, the second bracket 22 positions the flashlight below and to one side of the handgrip on the semi-automatic handgun. This location avoids interference with insertion and removal of a magazine from directly below the butt of the weapon. First and second brackets in both embodiments may comprise sheet metal such as aluminum or steel heat treated to obtain higher strength and resilience.

The flashlight is secured in the second bracket by means of bolts 36 and nuts 38. As shown in FIGS. 1, 2, and 3, the first bracket 16 is further secured to the handgrip 26 by means of elastic band 18 that is located around the circumference of the handgrip. The elastic band may be comprised of rubber or other elastomeric material. As shown, the first bracket extends only slightly past the front and rear portions of the grip, leaving one side substantially uncovered. By making the second bracket extend further around, the attachment could be secured by frictional action of the bracket alone. However, it is preferred to have this bracket extend only slightly past halfway around the circumference and to use this measure in combination with additional forced applied by the elastic band. If the first bracket extended farther around the circumference, it would require more hand pressure for installation, which would tend to mar the surface of the grip. Also, the elastic band required for brackets with the smaller area engaging the grip provides an added advantage, enabling a more convenient manner in which to operate the pressure switch, which is preferably located between the band and the bracket. Pressure switch 40 is provided and is electronically connected by leads 24 to the flashlight. The pressure switch 40 is located under the band 18 so that the light can be turned on by squeezing the grip of the handgun with the user's fingers in their normal position. Alternately, the switch 40 may be held in place by other means such as a hook and loop tape (Velcro™).

Figure 5:
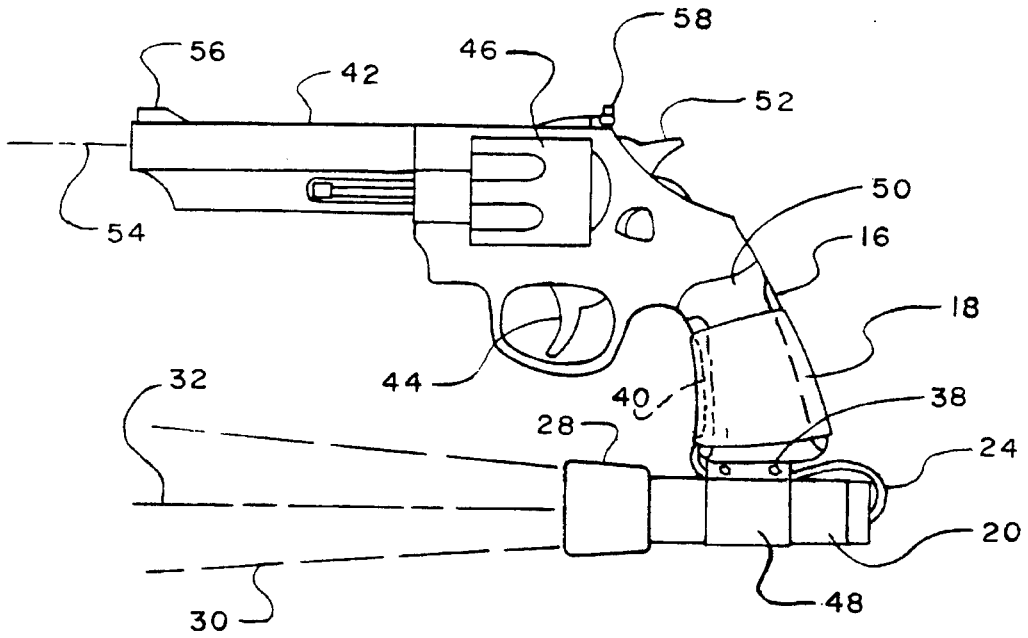
FIG. 5 is a left-side view of present invention attached to a revolver, showing the light mount positioned below the handgrip with the light pointed toward a target.

FIG. 5 shows a mounting bracket 16 for a revolver that extends past one side and front and rear portions of the handgrip 50 and includes a second bracket 48 that positions the flashlight directly below the revolver handgrip. An inner surface of each of the brackets may be provided with a resilient coating 19 of material such as an elastomer (FIGS. 4 and 7) so as to obtain enhanced contact between a bracket 16 and respective grip of a handgun.

Figure 7:
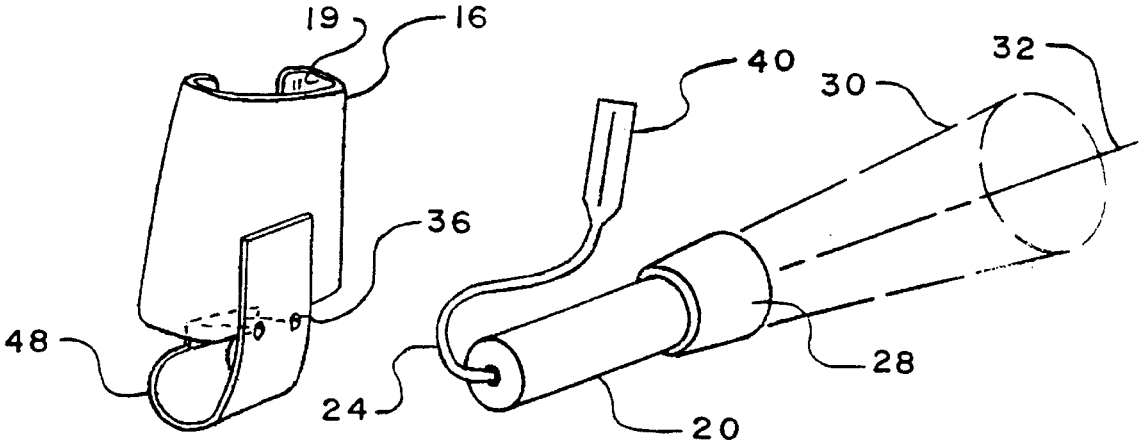
FIG. 7 is a perspective view of the light mount with the elastic band and flashlight removed. Also shown is the flashlight with a pressure switch attached.

FIGS. 4 and 7 show a perspective view of the light mount removed from the respective handgrips 26 and 50. Also, the elastic band 18 of the mount is removed so the first bracket 16 and second bracket 22 or 48 can be viewed. The first bracket 16 and the second bracket 22 or 48 are fastened together by welding or like process. Also shown in FIGS. 4 and 7 is the flashlight 20, circuit leads 24, and a pressure switch 40. As shown in FIGS. 1 and 5, at close range a light beam 30 is on line with the bore center 54 of the weapon to which it is attached. At longer ranges, the light beam is used for illumination, and the sights 56 and 58 are used for aiming.

As shown in FIGS. 4 and 7, the second bracket 22, 48 has an upper rectangular portion flush with a lower portion of a side of a first bracket to which it is attached. A lower portion of the secured bracket in each case is shaped to form an annular clamp which receives the flashlight. This structure avoids placement of a significant obstacle in position to interfere with the user's grasp of this region of the grip.

While the invention is described above with respect to two specific embodiments, it is not to be understood as limited to these embodiments, but is limited only as indicated by the appended claims.

What is claimed is:

1. A flashlight mounting device for a handgun, said handgun comprising a longitudinally extending barrel and a grip extending generally radially outward from said barrel, said grip having a front portion, a rear portion, first and second side portions, and a distal end, an attachment comprising:

a first bracket made of resilient sheet material and having a front portion, a rear portion, and a first side portion adapted to engage corresponding portions of said grip and to exert force onto said grip at surfaces on opposite sides of the grip whereby said attachment is supported by said first bracket;

said first bracket having a second side portion separated into two end segments by a vertical gap defined therein whereby said bracket may be attached to and removed from said grip; and a second bracket comprising a receptacle for receiving and supporting a flashlight, said second bracket fixedly secured to said first bracket in a manner such that when a flashlight is inserted in said receptacle, said flashlight will be pointed in the same direction as said gun barrel.

2. A mounting device as defined in claim 1 further comprising an elastic band adapted to encircle said first bracket and urge the same against said grip.

3. A mounting device as defined in claim 2 wherein said brackets comprise a resilient metal sheet.

4. A mounting device as defined in claim 3 wherein said second bracket comprises a flat upper portion welded to a lower portion of said first bracket and a lower portion of the second bracket comprises an annular clamp.

5. A mounting device as defined in claim 2 wherein said elastic band is a rubber band.

6. A mounting device as defined in claim 5 wherein said rubber band has a width such as to extend over most of the vertical length of said first bracket.

7. A mounting device as defined in claim 4 wherein said annular clamp is located generally below said distal end of said grip so as to avoid forming an obstacle to grasping said grip and to holstering of said handgun with the attachment installed thereon.

8. A mounting device as defined in claim 2 wherein said two end segments of said second side portion are adapted to extend only slightly past halfway around said grip.

9. A lighting attachment for a handgun, said handgun comprising a longitudinally extending barrel and a shaped grip extending outward therefrom comprising:

a first sheet metal bracket contoured to conform with said surface and adapted to be frictionally engaged with the same along a distance at least halfway around said grip; and a second sheet metal bracket comprising an upper portion welded flush to a lower portion of said first bracket and a lower portion of the second bracket having defined therein an annular clamp for receiving and supporting a flashlight.

10. An attachment as defined in claim 9 including an elastic band extending around said first bracket and urging the same against said grip.

11. An attachment as defined in claim 10 including a switch for turning the light on and off.

12. An attachment as defined in claim 11 wherein said switch is a pressure switch.

13. An attachment as defined in claim 12 wherein said pressure switch is located over said bracket and underneath said elastic band whereby the switch may be operated by squeezing of the band by fingers of a user.

14. An attachment as defined in claim 13 wherein said handgun is an automatic weapon.

15. An attachment as defined in claim 13 wherein said handgun is a revolver.

16. A flashlight mounting attachment for a handgun, said handgun having a longitudinally extending barrel and a shaped grip disposed generally radially outward from said barrel comprising:

a first bracket comprised of sheet material and having a C-shaped lateral cross section, said first bracket contoured to conform to the shape of said grip and arranged to frictionally engage the grip on front and rear portions and one side portion thereof, whereby the first bracket may be removably connected to the grip;

an elastic band completely encircling said first bracket, urging the same against said grip; and a second bracket made of sheet material connected to a lower portion of said side portion of said first bracket, said second bracket including a flashlight support aligning said flashlight with said barrel when installed.

17. The mounting attachment as defined in claim 16 wherein said brackets are comprised of metal.

18. The mounting attachment as defined in claim 17 wherein said second bracket is connected flush with a side portion of said first bracket.

19. The mounting attachment as defined in claim 18 comprising a pressure switch for operation of said flashlight disposed between said first bracket and said elastic band.

20. The mounting attachment as defined in claim 16 wherein said flashlight support comprises a portion of said second bracket formed into an annular clamp having an axis generally at a right angle to the length of said grip.

* * * * *